United States Patent [19]

Veldman

[11] Patent Number: 5,000,128

[45] Date of Patent: Mar. 19, 1991

[54] POWER TOOL DRIVE SYSTEM

[76] Inventor: Alphonsus G. G. Veldman, Bergerweg 63, 6063 BP, Vlodrop, Netherlands

[21] Appl. No.: 393,655

[22] Filed: Aug. 14, 1989

[30] Foreign Application Priority Data

Aug. 12, 1988 [AU] Australia ..... PI9804

[51] Int. Cl.[5] ..... F02B 71/04

[52] U.S. Cl. ..... 123/465 C

[58] Field of Search ..... 123/465 C, 46 H, 46 R, 123/196 V, 90.33, 196 R

[56] References Cited

U.S. PATENT DOCUMENTS

| | | | |
|---|---|---|---|
| 2,433,007 | 12/1947 | Weyandt | 123/46 SC |
| 3,345,976 | 10/1967 | Pope et al. | 123/90.33 |
| 3,998,199 | 12/1976 | Melchior | 123/90.33 |
| 4,377,991 | 3/1983 | Liesse | 123/46 SC |
| 4,483,280 | 11/1984 | Nikolich | 123/46 SC |
| 4,721,240 | 1/1988 | Cotta | 123/46 SC |
| 4,773,581 | 9/1988 | Ohtsu et al. | 123/46 SC |
| 4,821,683 | 4/1989 | Veldman | 123/46 SC |

FOREIGN PATENT DOCUMENTS

| | | | |
|---|---|---|---|
| 589279 | 12/1959 | Canada | 123/46 SC |
| 1229671 | 9/1960 | France | 123/46 SC |

*Primary Examiner*—David A. Okonsky

*Attorney, Agent, or Firm*—Stevens, Davis, Miller & Mosher

[57] ABSTRACT

A portable power tool including a body in which a bore (4) is formed and a piston (3) is slidable within the bore. A combustion chamber (2) is formed in the body and is in communication with the bore. The combustion chamber (2) is arranged to receive a gaseous fuel from a source (5). An inlet port (6) into the chamber (2) and an outlet port (12) therefrom are controlled by a valve means (10). Preferably the arrangement is such that fuel entering the chamber through port (6) scours the chamber (2) of residual gases through port (12). The tool preferably has various additional features such as means for monitoring the valve means in an open condition for a preselected time. That means may include a detent catch (39), and an actuating membrane (32). A lubrication system (94) may be provided for lubricating the valve means. A fuel deflecting vane (80) may be mounted in the combustion chamber to improve turbulence therein. Also, the piston may have a vacuum detent arrangement (75) for holding the piston towards the combustion chamber (71) during the initial stages of combustion in the chamber.

26 Claims, 3 Drawing Sheets

POWER TOOL DRIVE SYSTEM

Figures 1, 3:
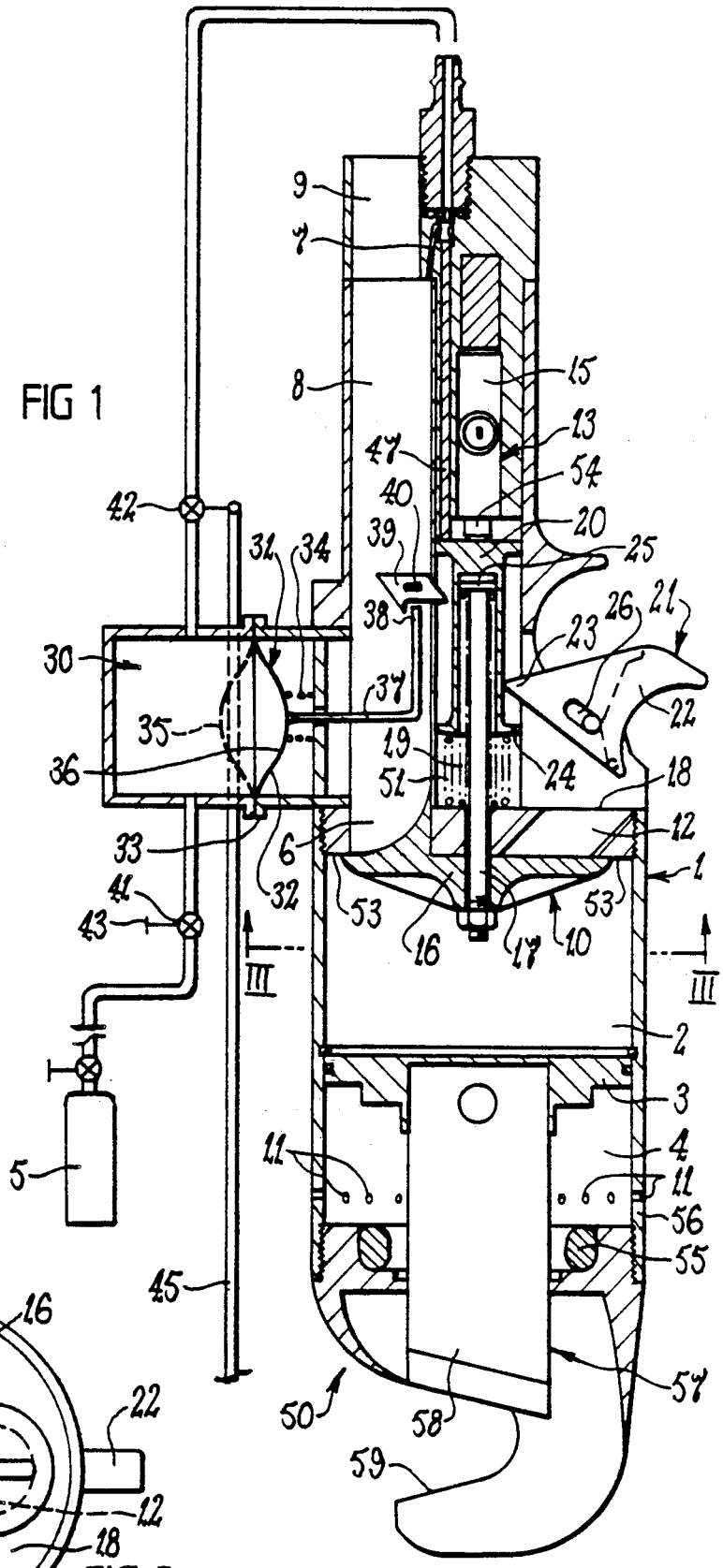

This invention relates to portable power tools of the kind which are driven by combustion of a gaseous or vapourised fuel, and is particularly concerned with the drive mechanism or power source for such tools.

Power tools operated by internal combustion are known, and examples of such tools are disclosed by U.S. Pat. Nos. 4,821,683 and 4,483,280. Prior to the present invention, such tools have had limited commercial success, and that is mainly due to the difficulty in developing a satisfactory drive mechanism or power source. In particular, it has been difficult to extract sufficient energy from the combustion operation to drive the tool against substantial resistance, and that has limited the range of application of such tools.

A particular problem with a power tool of the type disclosed in U.S. Pat. No. 4,821,683 occurs during the purging of gas from the previous cycle of the tool by a fresh charge of fuel. A significant feature of that patent is the manner in which incoming fuel entering the combustion chamber of the tool purges the chamber of gases from the previous cycle. It has, however, been found that inexperienced operators cannot easily monitor the flow of fresh gas into the combustion chamber so that frequently fresh gas passes through the combustion chamber and out through the exhaust port. This is undesirable since it is wasteful and can lead to a dangerous situation where over purging occurs in confined spaces. The unburnt gas can accumulate in the confined space until a potentially explosive situation arises.

It is an object of the present invention to provide a drive mechanism or power source for tools of the foregoing kind, which is efficient in use and provides a relatively high energy output. It is a further object of the invention to provide a portable power tool incorporating such a mechanism or power source. A yet further object is to provide a tool which does not discharge significant quantities of unburnt fuel into the atmosphere.

A power source according to the invention is of the same general form as that disclosed by U.S. Pat. No. 4,821,683. That is, it includes a combustion chamber, a piston or other member arranged to be driven by combustion occurring within the chamber, fuel ignition means, and valve means controlling flow into and out of the chamber. It has been found to be advantageous for the purposes of creating an effective power stroke for ignition of fuel within a combustion chamber of the tool to be rapid resulting in rapidly increasing pressure within the combustion chamber prior to the piston moving an appreciable distance on its power stoke. The rapid rate of combustion can be enhanced by creating turbulence within the combustion chamber, optionally selecting the position of the ignition spark, and effectively purging the combustion chamber of residual gases prior to ignition of a new power stroke. An optional feature of the invention is concerned with means for holding back the piston during initial stages of the power stroke to thereby allow an appreciable pressure build-up. A further feature of the invention relates to the piston. The piston preferably carries only a short striker on the forward end thereof for effecting a work operation. This configuration will allow the piston to travel unguided by an axially aligned guide rod for at least a portion of its travel and guiding will be provided for this portion of travel by the piston coacting with the cylinder. The invention further provides that gas is admitted into the combustion chamber from a metering chamber which supplies a measured quantity of gas to the combustion chamber. There are additional characterising features of the new power source as will be evident from the following description.

Figure 2:
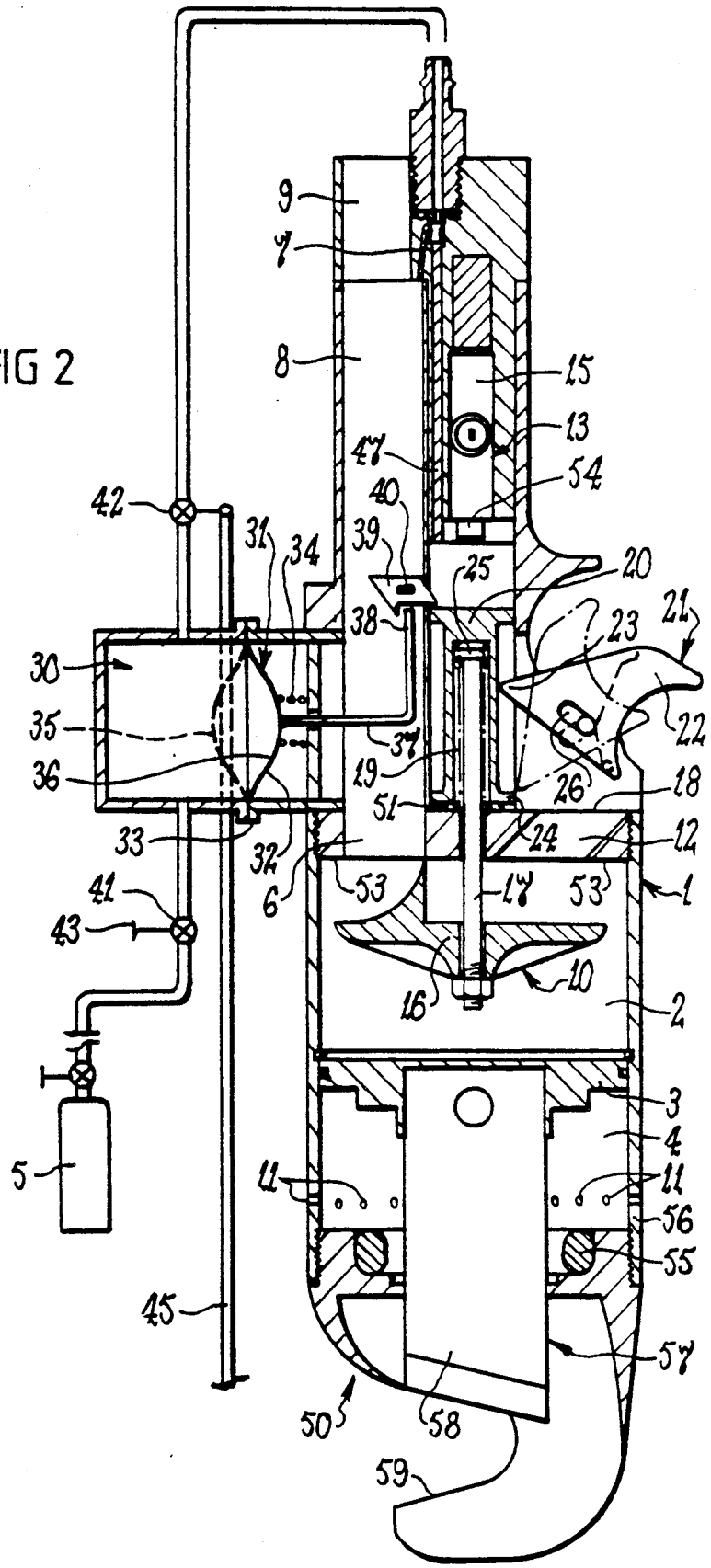
Figure 4:
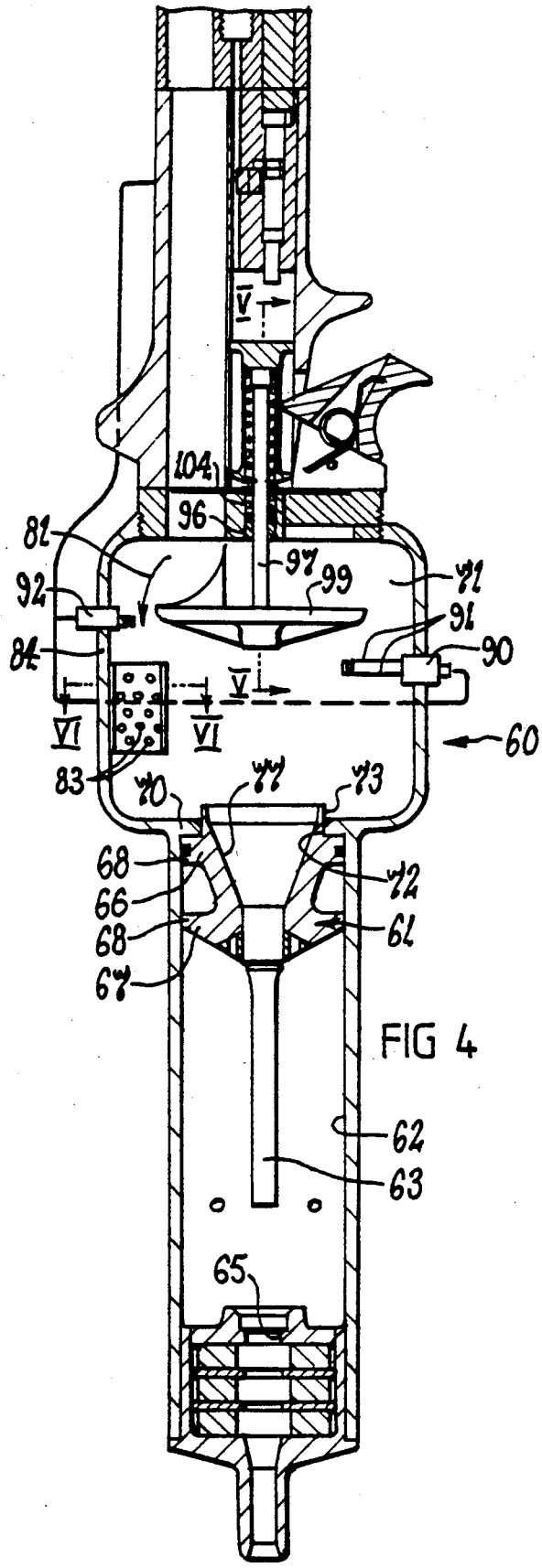
Figure 7:
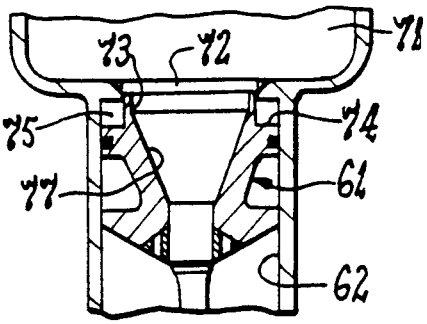
Figure 5:
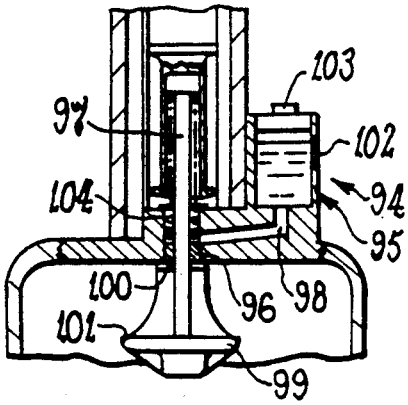
Figure 6:
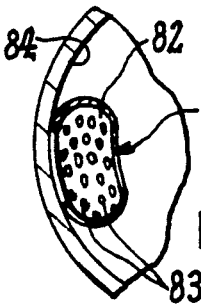

Two embodiments of the invention are described below by way of examples reference being made to the accompanying drawings in which:

FIG. 1 shows a cross-sectional side view of a first embodiment of the invention with the valve means therefor in a closed condition, FIG. 2 shows a similar view of the tool depicted in FIG. 1, but with the valve means in an open position, FIG. 3 shows a cross-sectional view through the combustion chamber of the tool depicted in FIG. 1 along line III—III, FIG. 4 shows a cross-sectional side view of a second embodiment of tool according to the invention, FIG. 5 shows a cross-sectional side view of portion of the tool of FIG. 4, FIG. 6 shows a cross-sectional view along line VI—VI of FIG. 4, and FIG. 7 shows a cross-sectional side view of another portion of the tool shown in FIG. 4, after the piston has begun to move away from its rest or ready to fire position.

The power source 1 depicted in FIGS. 1 and 2 includes a combustion chamber 2 which is preferably of cylindrical or part spherical form, and a piston 3 which is slidably located in a cylinder 4 therefor which is in communication with that combustion chamber 2. A source 5 of combustible fuel is connected to the combustion chamber, and in one arrangement that fuel is a gas such as butane, propane or MAPP (methylacetylene propadiene) stored under pressure. Other types of fuels may be utilised according to preference or availability. The fuel storage is connected to an inlet port 6 of the combustion chamber 2, and passage of fuel to that port may be regulated by a suitable fuel control valve 7.

In the arrangement shown, fuel emerging from the fuel storage 5 passes through a venturi before entering the combustion chamber 2 so that air is drawn into the fuel stream through air inlet 9. The resulting fuel-air mixture is introduced into the combustion chamber through the fuel inlet port 6, and valve means 10 is operable to open and close that port 6 as hereinafter described.

Combustion residue products are exhausted from the combustion chamber mainly through exhaust ports 11 provided at the end of the cylinder 4 remote from the combustion chamber but also through at least one outlet port 12, and the aforementioned valve means 10 is also operable to open and close the or each such outlet port 12.

Ignition means 13 for igniting the fuel charge in the chamber 2 can take any appropriate form. In the arrangement shown in the drawings, that ignition means includes an electrode 14 which is exposed within the chamber and a piezo electric (PE) crystal assembly 15 which is connected to the electrode 14 and is operable to generate a spark at the electrode 14.

The valve means 10 which controls the inlet and outlet ports 6 and 12 preferably includes a closure member 16 in the form of a plate which is located within the combustion chamber 2, at least when the ports 6 and 12 are open. In the arrangement shown, that closure plate 16 is mounted on an end of a valve stem 17 which is slidable axially within an end wall 18 of the combustion chamber 2. The inlet and outlet ports 6 and 12 are formed in that end wall 18 and in a preferred arrangement the outlet port 12 is at least 1.5 times the size of the inlet port. In an alternative arrangement, (not shown), there is a single inlet port 6 and two outlet ports 12.

Where three ports are employed it is preferred to arrange the three ports in a group having a triangular formation, and in that event the valve stem can be located in the centre of the group and the closure plate can be of tri-lobular form and arranged so that each lobe is operable to close a respective one of the three ports. Guide means (not shown) may be provided to hold the valve closure plate 16 against rotation about the axis of the valve stem 17 relative to the chamber body. That means may include a guide pin connected to the closure plate or stem and arranged to cooperate with a fixed part of the chamber body. Other forms of guide means could be used.

Whatever the configuration of ports 6 and 12, it is preferred that the inlet port 6 is separated from the outlet port 12 or ports, that is the inlet and outlet ports are provided through separate openings in the wall 18 of the combustion chamber 2.

Opening and closing of the ports is controlled by axial movement of the valve stem 17, and in the arrangement described, there is simultaneous opening and closing of the ports 6 and 12. The valve closure plate 16 is preferably biased towards the port closed position by a spring 19 acting on the valve stem 17 between the wall 18 and the end 25 of the stem 17 remote from the plate 16.

Actuator means 21 is operable to cause the closure plate 16 to lift away from the chamber end wall 18 containing the ports 6 and 12 and thereby open the ports 6 and 12. In one form, that actuator means includes a finger operable trigger mechanism 22 having a lug 23 which is engageable with a shoulder 24 or other abutment provided on a shuttle 20 located on the end 25 of the stem 17. Alternatively, the lug 23 could be arranged to contact the stem directly. Operation of the trigger mechanism 22 causes the lug 23 to push against the abutment 24 and thereby move the valve stem 17 axially into the port open position depicted in FIG. 2 against the competing influence of the biasing spring 19. The arrangement is preferably such that the lug automatically disengages from the abutment 24 when the closure plate 16 has been lifted to a predetermined distance clear of the ports 6 and 12, and the extent of that distance can be established to suit particular requirements.

Fuel is preferably admitted to the combustion chamber 2 in a controlled manner, that is, only sufficient fuel is introduced to the chamber to purge residual gas from the chamber, but not so much as to allow uncombusted gas to exhaust through outlet port 12. This feature may be achieved in various ways, but a preferred manner is to supply fuel from the source 5 to the control valve 7 through a metering chamber 30. The metering chamber 30 is preferably of variable volume having one wall 31 formed by a diaphragm 32 which is clamped around its periphery, as indicated at numeral 33. A spring 34 urges the diaphragm towards a reduced volume position as indicated by dotted lines 35, and as pressure increases in the metering chamber 30 the diaphragm moves to an enlarged volume position as indicated by numeral 36.

The diaphragm 32 has an actuating lever 37 attached thereto which moves with the diaphragm. The free end 38 of the lever 37 is arranged to act on a detent catch 39 mounted to the tool. The detent catch 39 has an elongate slot 40 formed therein which allows the catch 39 to move backwards and forwards as required. The catch 39 is spring biased towards engagement with the shuttle 20. The detent catch 39 is adapted to hold the shuttle 20 and hence the valve means 10, in an open position whilst fuel discharges from the metering chamber 30 into the combustion chamber 2. Two valves 41 and 42 control the flow of fuel to and from the metering chamber 30 respectively. Valve 41 is located between the fuel source 5 and the chamber 30, and valve 42 is located between the chamber 30, and the control valve 7. Valve 41 is a restricted valve, that is, fuel does not flow unchecked therethrough, but rather fuel flows therethrough at a reduced rate. Adjustment means 43 is provided to vary the degree of restriction.

Valve 42 is optional, and is provided as a safety measure. Valve 42 may be linked to a front of tool actuating arrangement, depicted diagrammatically at numeral 45. The actuating arrangement may operate such that valve 42 is only open when the tool is operatively located against a workpiece. Valve 42 may, in addition, be connected to the trigger mechanism 22 so that valve 42 is only open when both trigger mechanism 22 and actuating arrangement 45 are operatively depressed, and thus fuel can not inadvertently flow into combustion chamber 2.

When the trigger mechanism 22 is depressed the shuttle will move forward past the detent catch 39, and detent catch 39 will snap into engagement behind shuttle 20 to hold the valve means 10 momentarily open. The movement of shuttle 20 away from its rest position allows the rod 47 which operates control valve 7 to open control valve 7 and fuel flows from the metering chamber 30, through valve 7 into combustion chamber 2. Fuel in the chamber 30 is under pressure prior to this occurring, and diaphragm 32 is in the position indicated by numeral 36. As pressure drops in metering chamber 30 spring 34 moves the diaphragm 32 to position 35. Fuel entering chamber 30 does not maintain high pressure in the chamber due to the restricted nature of valve 41. As diaphragm 32 moves to position 35 the lever 37 acts on detent catch 39 to disengage the catch 39 from the shuttle 20 and allows the valve means to move rapidly back to its closed position under influence of spring 19. As the shuttle 2 reaches the rest position it will close the control valve 7 and strike the plunger 54 on crystal assembly 15 causing electrode 14 to spark and ignite the fuel in the combustion chamber 2.

Thus, a predetermined volume of fuel will enter combustion chamber 2, the volume of fuel depending on the time taken for detent catch 39 to disengage, which in turn will be determined by the extent to which flow through valve 41 is restricted, as well as the force of spring 34. The setting on valve 41 and the strength of spring 34 will be selected so that fuel entering chamber 2 does so in a manner scouring the chamber 2 of residual gases from a preceding cycle of operation of the tool, and sweeps those residual gases out through the outlet 12 prior to the valve means 10 closing. However, only a limited quantity, if any, of unburnt gas will at the same time pass out through the port 12. Thus, the valve means is held open first only so long as it takes to scour residual gases from the chamber. It is envisaged that this will be approximately 400 ms.

An alternative trigger arrangement (not shown) will be for the trigger to be incorporated into a trip safety mechanism cooperating with the front portion 50 of the tool and actuable by pressing the front end of the tool against a work surface. This arrangement is not really applicable for a primary device as shown in FIGS. 1 and 2 but could be used with a fastener driving tool as shown in FIG. 4. This arrangement will have the advantage that operation of the tool may be made automatic by pressing the tool in the forward direction as opposed to actuation by a trigger mechanism 22 which could be tiring for the trigger finger if multiple firings are done.

When the aforementioned disengagement of the trigger mechanism 22 and detent catch 39 occurs, the closure plate 16 is driven back towards the port closed position under the influence of the biasing spring 19. Because of the plate-like nature of the closure member 16, that return movement creates substantial turbulence within the chamber 2. Such turbulence benefits the combustion process as hereinafter explained and also promotes effective purging of combustion residue products through the outlet port or ports 12. When the closure member 16 reaches the port closed position, the lug 23 of the trigger mechanism 22 will have repositioned itself to be again engageable with the valve stem abutment 24. A slot 26 is provided in the trigger mechanism to allow the lug 23 to ride over abutment 24 when the trigger returns to its rest position.

Operation of the aforementioned ignition means 13 is preferably achieved through operation of the trigger 22 or trip safety mechanism. As shown in the drawings the shuttle 20 is mounted substantially coaxial with the valve stem 17 and is located at or adjacent the end of that stem 17 remote from the valve closure plate 16. The shuttle 20 is movable axially relative to the valve stem 17 and is spring influenced in a direction away from the closure plate end of the stem 17. A shuttle spring 51 is preferably separate from the valve biasing spring 19 and acts to urge the shuttle 20 back to its rest position before the closure plate 16 reaches its closed position. This is achieved by selecting springs 19 and 51 having a spring force adapted to achieve this ignition and closure sequence. The trigger mechanism lug 23 may influence movement of the shuttle 20 in the same manner as it influences movement of the valve stem 17. That is, the arrangement is such that the shuttle 20 moves with the valve stem 17 in the port opening direction while the lug 23 continues to push against the aforementioned abutment 24.

The shuttle 20 preferably has two functions. One is to cause operation of the fuel control valve 7, and the other is to cause operation of the ignition means 13. Each function is dependent upon axial movement of the shuttle 20 as hereinafter described.

When a tool including a power source as described is in a ready to use condition, the valve means 10 is in a closed condition and the shuttle 20 is in a rest position at which it presses against rod 47 to cause the fuel control valve 7 to be closed. Operation of the trigger mechanism 22 causes the valve stem 17 and shuttle 20 to move together in a direction such that the closure plate 16 of the valve moves clear of and opens the chamber inlet and outlet ports 6 and 12. The degree of that opening progressively increases as the closure plate 16 is lifted further by operation of the trigger mechanism 22. At some time in that lifting movement, and preferably after the valve plate 16 has lifted about 3 mm off its seat 53, the shuttle 20 allows the fuel control valve 7 to open.

Opening of the fuel control valve 7 results in fuel under pressure being sprayed into and through the venturi 8. Air is thereby entrained in the fuel stream which then enters the chamber through the now open inlet port 6. A fuel-air mixture charge is thereby introduced into the chamber 2 as the closure plate 16 is advancing towards its most upward position relative to the chamber ports 6 and 12. The closure plate 16 may lift off the valve seat 53 a maximum distance approximately equal to the diameter of the venturi 8. This relatively large opening allows unrestricted fuel-air mixture flow into the combustion chamber 2.

When the valve stem 17 and shuttle 20 are eventually released from the influence of the trigger mechanism lug 23, each commences to travel in a return movement direction under the influence of their respective biasing springs 19 and 51. In that regard, each of the springs 19 and 51 has undergone progressive stress increase—e.g., compression—as a consequence of the upward travel of the valve stem 17 and shuttle 20. At least at the time of release from the influence of the trigger mechanism lug 23, the shuttle spring 51 imposes a spring force which is greater than that of the valve closure spring 19 relative to the respective phases thereof. The rate of return travel of the shuttle 20 is thereby caused to be faster than that of the valve stem 17, and closing movement of the valve closure member 16 therefore lags behind movement of the shuttle 20 into its rest position.

As the shuttle 20 reaches or approaches the rest position, it performs two functions. One is to cause the fuel control valve 7 to close, and that will usually be the first of the two functions, or at least it will occur simultaneous with the second function. The second function is to strike the aforementioned plunger 54 or other device which activates the PE crystal assembly 15 so that a spark is generated at the chamber electrode or electrodes 14.

The advance return travel of the shuttle 20 therefore results in the fuel charge being ignited before the chamber ports 6 and 12 are quite closed. The time difference between that ignition and closing of the ports 6 and 12 may be quite small, and is preferably pre-established so that ignition occurs as the fuel charge within the chamber 2 is subjected to maximum turbulence. As previously stated, turbulence is generated within the fuel charge by, amongst other factors, the inflowing gas mix and the return movement of the valve closure plate 16. Combustion at the time of maximum turbulence has the potential to optimise flame propegation thereby improving the burn rate, decrease the time to reach peak pressure and increase the level of that pressure by that combustion.

Combustion residue remaining in the chamber 2 after a previous combustion process, is exhausted through the outlet port 12 during purging.

As the closure plate 16 reaches its fully closed position, the full influence of the combustion energy is directed against the piston 3 which is thereby driven away from the aforementioned chamber end wall 18. The piston 3 is thereby moved through a tool operating power stroke. As the piston 3 reaches the limit of its travel on a power stroke it preferably strikes a resilient bumper 55 located at the end 56 of the cylinder 4 remote from the combustion chamber 2. At the extreme limit of travel when the piston 3 is against the bumper 55, exhaust ports 11 are exposed behind the piston 3 and the major portion of spent gas behind the piston 3 is able to exhaust through these ports 11. The resilience of the bumper 55 will then initiate return movement of the piston 3 to a position in which those exhaust ports 11 are closed. Thereafter, the hot gases which remain in the tool after the power stroke will collapse as a result of cooling and the partial vacuum thereby created will return the piston 3 to its retracted, ready to fire, position. The length of the tool operating stroke will depend upon the nature of the tool with which the power source is used. In any event, an operable component 57 of the tool is connected to or influenced by the piston 3 in a manner such as to respond to piston movement. As shown in FIGS. 1 and 2 that component 57 is a blade 58 arranged to coact with a fixed blade 59 in a slicing action so that the tool can be used as a pruning device.

Turning now to FIGS. 4 to 7 of the drawings a nailing tool 60 is shown in which the piston 61 in the tool is guided only by the cylinder 62 within which it travels. The piston 61 need thus not have an axially aligned guide rod on the forward end thereof. As shown in the drawings the piston 61 is provided with a short striker rod 63 on the forward end 64 thereof for effecting a work operation and the striker rod 63 may pass into a guide socket 65 only during the latter portion of the travel of the piston 61 within the cylinder 62. The piston 61 itself may be configured in a manner which allows regard a piston 61 of extended axial length is envisaged. The piston 61 is preferably formed having two disc like portions, 66,67 axially spaced, the peripheries 68 of which engage the wall of the cylinder 62 to hold the piston 61 in alignment within the cylinder. An advantage of this arrangement is that the length of the tool 60 measured in the direction of the cylinder axis can be kept to a minimum for any particular length of cylinder 62 in that no provision need be made to accommodate the piston guide rod. The length of the tool measured as aforesaid is determined by the length of the cylinder. Accordingly a longer cylinder 62 may be employed for a comparable overall length of tool 60 compared with systems where the piston is guided over its entire length of travel by a guide rod. The absence of a guide rod will allow greater distance of piston travel and minimise frictional resistance to movement. Another advantage of a longer cylinder enables the piston 61 to be accelarated for a longer period resulting in increased velocity at the end of the piston travel. Increased velocity will in turn lead to greater impact energy being imparted at the point of impact.

The absence of a full length guide rod enables the overall weight of the piston to be of lighter construction. A light weight piston provides certain advantages such as minimising recoil, and minimising piston momentum at the end of the power stroke thereby enabling the tool 60 to be of lighter construction. The piston 61 may thus be formed of a lightweight alloy material whilst the striker rod 63 will be made from a high strength steel or the like.

A transverse wall 70 may be located between the combustion chamber 71 and the cylinder 62 in which the piston 61 slides. This transverse wall 70 will have a transfer port 72 therethrough in order that pressure generated in the combustion chamber 71 can be conveyed to the piston 61 to drive the piston 61 on its power stroke. In the illustrated form of the invention the piston 61 carries a closure plug 73 on the back face 74 thereof and this plug 73 fits into the transfer port 72 when the piston 61 is in a fully retracted position as shown in FIG. 4. Preferably the plug 73 and transfer port 72 are of cooperant cross-sectional shape, both being of substantially cylindrical form. The plug 73 fits within the transfer port in a reasonably close sliding fit.

With this configuration, a detent chamber 75 (more clearly seen in FIG. 7) will be defined between the back face 74 of the piston 61 and the transverse wall 70 when the piston is in its retracted position and the plug 73 is located within the transfer port 72. A partial vacuum will be created when the piston 61 starts to make its movement as indicated in FIG. 7 in a direction away from combustion chamber 71 on a power stroke. That partial vacuum in chamber 75 impedes initial piston movement and by the nature of the detent, shields part of the back face 74 of the piston from full combustion chamber pressure.

The partial vacuum in the detent chamber 75 will preferably act as a vacuum detent on the piston 61 during initial stages of combustion holding back the piston 61 momentarily whilst pressure builds up in combustion chamber 71. An increase in pressure in the combustion chamber 71 will act on the central area 77 of the piston 61 exposed through transfer port 72. As pressure increases in the combustion chamber 71 the pressure on the central area 77 will cause the piston 61 to move against the action of the partial vacuum in the detent chamber 75. As soon as the plug 73 moves out of the transfer port 72 the pressure in the combustion chamber 71 will be introduced into the now open detent chamber 75 and this high pressure will act on the full back face of the piston 61 resulting in the piston being driven with full force on its power stroke. The short delay as a result of the vacuum detent will cause the piston 61 to be held back until such time as the pressure in the combustion chamber 71 increases significantly resulting in a more efficient power stroke.

The size of the transfer port 72 should not be so small as to cause a throttling effect for gasses passing from the combustion chamber 71 to the cylinder 62. The vacuum detent is advantageous as it operates automatically, requires no mechanically movable parts, and is not subject to mechanical wear. The force of the detent will be selected for the particular application for which the tool 60 is intended and will depend on the size of the transfer port, and the accuracy of the sliding fit between plug 73 and port 72.

It will also be possible to mount a swirl or deflector plate 80 within the combustion chamber 71. In one form of the invention, and as clearly shown in FIG. 6 that swirl plate 80 is of part cylindrical form and is positioned so that incoming gases 81 impinge against the concave face 82 of the swirl plate 80 and curl around towards the centre of the combustion chamber 71. The swirl plate 80 may have a plurality of apertures 83 therein such that some portion of the stream of gas directed towards the surface of the swirl plate 80 passes through the plate 80, and another portion of that stream is curled away by the curved form of the plate 80. Clearly the swirl plate 80 may have a different configuration to that described above, but the effect of the plate will be to break up laminer flow of the incoming gas stream 81 and generally create turbulence within the combustion chamber 71 thereby preparing the fuel charge for ignition.

The stream of incoming gas 81 into the combustion chamber should preferably be aligned so as to enter the combustion chamber in a direction which is substantially tangential to the wall 84 of the combustion chamber. It has been found that gas introduced at directions other than tangentially to the combustion chamber wall still produce combustion, although when the angle away from the tangential is more than about 45° the combustion results are less than satisfactory. A swirl plate (not shown) may optionally be positioned in the path of this stream prior to entering the combustion chamber 71 such that the incoming stream is swirling as it enters the combustion chamber.

As shown in FIG. 4 of the drawings at least one electrode 90 maybe of a form such that the spark takes place at substantially the centre of the combustion chamber 71 rather than towards one or other sidewall 84 of that chamber 71. For this purpose the electrode 90 may take the form of a pair of elongate electrode members 91 which extend towards the centre of the combustion chamber 71 and define a spark gap between their free ends.

Alternatively, or in addition, there may be multiple electrodes. FIG. 4 shows two electrodes 90 and 92 adapted to generate a spark simultaneously with each other to thereby provide simultaneous ignition at different points within the combustion chamber 71. The PE crystal assembly may be actuated by depression of a plunger, and such depression is effected through actuator means as described above. The whole fuel inlet system outlet ports, and fuel supply can be the same as that depicted in FIGS. 1 to 3.

The valve stem of the tool is preferably lubricated to ensure smooth and regular operation of the valve means. A lubrication system 94 is depicted in FIG. 5 and may take the form of a lubricant reservoir 95 which is in communication with the guide passage or sleeve 96 in which the valve stem 97 slides. Communication may take place through a passage 98 which is transverse to the valve stem sleeve 96 and links the resevoir 95 with that sleeve 96. When the valve plate 99 moves to a valve open position lubricant will adhere to the valve stem 97 and be carried up by the valve stem 97 to the outer end 100 of the sleeve 96. When the valve moves 99 to a valve closed position the lubricant will be scraped off the valve stem 97 and will adhere to the valve 99. Valve closure will then result in lubricant splashing or flowing towards the peripheral region 101 of the closure plate 99 providing lubrication, a buffer effect for the closure plate 99, and enhanced sealing for the closure plate 99. The reservoir 95 will preferably include a transparent wall 102 such that visual inspection of the amount of lubricant remaining in the reservoir at any one time is possible. A suitable fill plug 103 will be provided for replenishment.

Sealing means 104 may be located between the valve stem 97 and the guide passage therefor at a point between the lubrication passage 98 and the end of the stem remote from the valve closure plate 99. This sealing means 104 will ensure that lubricant does not discharge into areas of the tool where it is not required. An "O" ring seal is a preferred sealing means.

It is important that lubricants used do not interfere with the combustion of the tool and for this purpose it may be preferable not to use organically based lubricants. Gas within the combustion chamber 71 may dissolve in certain lubricants which will be disadvantageous to the combustion properties of the gas and the lubricating characteristics of the lubricant. Synthetic lubricants such as silicone based lubricants may be less prone to these problems.

A power source as described has the advantage of decreasing the time to maximum pressure and increasing the useable level of energy available to drive an associated tool, and it achieves that advantage without the need for complicated and expensive mechanism. It is also submitted that the tool will be safer than other similar tools in that unburnt gas will not escape through the tool.

It is to be understood that various alterations, modifications and/or additions may be introduced into the constructions and arrangements of parts previously described without departing from the spirit or ambit of the invention.

Having now described my invention, what I claim as new and desire to secure by Letters Patent is:

1. A portable power tool comprising:

a body;

a bore within said body;

a piston, slidably mounted within said bore for movement in one direction from a first position through a power stroke into a second position and in an opposite direction through a return stroke;

a combustion chamber formed in said body and communicating with said bore at an end remote from said second position of said piston and being arranged to receive a gaseous fuel for ignition and combustion;

inlet means for admitting said fuel to said combustion chamber;

outlet means for exhausting residual gases from said combustion chamber;

valve means operable to control said admission and said exhaust through said inlet means and outlet means respectively;

supply means for supplying said fuel to said inlet means;

ignition means for igniting said fuel in said combustion chamber;

a transverse wall formed within said body between said combustion chamber and said bore;

a transfer port formed through said transverse wall which provides said communication between said combustion chamber and said bore;

a closure plug formed on a rear face of said piston, said plug being shaped and configured to fit in a close sliding fit within said transfer port when said piston is in its first position; and a detent chamber being formed between said rear face of said piston and said transverse wall, the configuration of said plug, said transfer port, and said detent chamber being such that after combustion has occurred within said combustion chamber said piston will be momentarily held back substantially against said transverse wall during initial pressure build up within said combustion chamber, and prior to said pressure reaching a peak within said combustion chamber said piston will move away from said transverse wall, said plug will move out of said transfer port, and elevated pressure within said combustion chamber will act on the full rear face of said piston to cause rapid movement under power of said piston, through said power stroke towards said second position, said piston being arranged to effect a required power assisted operation.

2. A power tool according to claim 1 wherein said closure plug comprises a cylindrical skirt upstanding from the rear face of said piston, said transfer port comprises a correspondingly shaped opening of lesser diameter than said bore, said skirt having an axial length which is greater than the thickness of the transverse wall such that said piston can move a short distance away from said transverse wall without the skirt moving completely out of the transfer port.

3. A power tool according to claim 1 wherein the diameter of the transfer port is approximately 75% the diameter of the bore.

4. A power tool according to claim 1 wherein said piston is guided within said bore over at least a significant portion of the distance it travels between said first and second positions only by the coaction of said piston with the wall of said bore.

5. A portable power tool comprising:

a body;

a bore within said body;

a piston, slidably mounted within said bore for movement in one direction from a first position through a power stroke into a second position and in an opposite direction through a return stroke;

a combustion chamber formed in said body and communicating with said bore at an end remote from said second position of said piston and being arranged to receive a gaseous fuel for ignition and combustion;

inlet means for admitting said fuel to said combustion chamber;

outlet means for exhausting residual gases from said combustion chamber;

valve means operable to control said admission and said exhaust through said inlet means and outlet means respectively;

supply means for supplying said fuel to said inlet means; and ignition means for igniting said fuel in said combustion chamber;

whereby subsequent combustion of said fuel creates an elevated pressure condition within said combustion chamber which acts on said piston to cause rapid movement under power of said piston, through said power stroke towards said second position, said piston being arranged to effect a required power assisted operation;

said piston carrying a short striker rod on the side thereof remote from the combustion chamber, said piston being unguided by said striker rod over at least a significant portion of the distance it travels between said first and second positions, guidance for said piston over said significant portion being provided by said piston coacting with the wall of said bore.

6. A power tool according to claim 5 wherein said piston has an axial length approximately equal to its diameter, and said piston engages the wall of said bore at at least two axially spaced circumferential zones along its length.

7. A power tool according to claim 5 wherein said piston is formed from a lightweight alloy material and said striker rod is formed from a high strength material.

8. A power tool according to claim 1 wherein fuel is introduced into said combustion chamber from a metering chamber, control means limiting the volume of fuel being introduced to substantially the volume of said combustion chamber.

9. A portable power tool comprising:

a body;

a bore within said body;

a piston, slidably mounted within said bore for movement in one direction from a first position through a power stroke into a second position and in an opposite direction through a return stroke;

a combustion chamber formed in said body and communicating with said bore at an end remote from said second position of said piston and being arranged to receive a gaseous fuel for ignition and combustion;

inlet means for admitting said fuel to said combustion chamber;

outlet means for exhausting residual gases from said combustion chamber;

valve means operable to control said admission and said exhaust through said inlet means and outlet means respectively;

supply means for supplying said fuel to said inlet means;

ignition means for igniting said fuel in said combustion chamber;

a metering chamber in communication with said combustion chamber through said inlet means;

a restricted fuel inlet into said metering chamber arranged to be connected to a source of pressurized fuel;

pressure sensitive means for detecting a drop in pressure in said metering chamber;

a trigger means for opening said valve means to allow fluid to flow from said metering chamber to said combustion chamber; and a detent catch for holding said valve means in an open condition;

said pressure sensitive means being linked to said detent catch such that when in use fuel flows from said metering chamber to said combustion chamber causing a drop in pressure in said metering chamber said pressure sensitive means acts to cause said detent catch to disengage said valve means causing said valve means to move towards a closed position;

whereby subsequent combustion of said fuel creates an elevated pressure condition within said combustion chamber which acts on said piston to cause rapid movement under power of said piston through said power stroke towards said second position, said piston being arranged to effect a required power assisted operation.

10. A power tool according to claim 9 wherein said metering chamber includes a wall portion which is movable so as to be able to decrease the volume of said metering chamber, said wall portion being spring biased to a reduced volume position, said wall moving to its reduced volume position when pressure within said chamber drops, said movement causing said detent catch to disengage said valve means.

11. A power tool according to claim 10 wherein said wall portion comprises a flexible diaphragm.

12. A power tool according to claim 9 wherein said restricted fuel inlet includes an adjustable valve operable to vary the flow rate of fuel supplied to said metering chamber.

13. A power tool according to claim 9 wherein said trigger means includes a finger operable component and a front of tool component, said front of tool component being operable by pressing the front of the power tool against a work-piece, operation of said tool requiring the actuation of both said trigger components.

14. A power tool according to claim 9 wherein said detent catch automatically engages said valve means when said valve mean moves to said open position.

15. A power tool according to claim 1 wherein said combustion chamber has at least one flow directing vane mounted therein arranged to create turbulence in fuel admitted to said combustion chamber.

16. A portable power tool comprising:

a body;

a bore within said body;

a piston, slidably mounted within said bore for movement in one direction from a first position through a power stroke into a second position and in an opposite direction through a return stroke;

a combustion chamber formed in said body and communicating with said bore at an end remote from said second position of said piston and being arranged to receive a gaseous fuel for ignition and combustion;

inlet means for admitting said fuel to said combustion chamber;

outlet means for exhausting residual gases from said combustion chamber;

valve means operable to control said admission and said exhaust through said inlet means and outlet means respectively;

supply means for supplying said fuel in a gaseous stream to said inlet means;

at least one flow directing vane mounted within said combustion chamber against which said gaseous fuel stream will impinge when said fuel enters said combustion chamber, said vane being configured and arranged such that laminer flow within said stream is broken up into turbulent flow; and ignition means for igniting said fuel in said combustion chamber;

whereby subsequent combustion of said fuel creates an elevated pressure condition within said combustion chamber which acts on said piston to cause rapid movement under power of said piston, through said power stroke towards said second position, said piston being arranged to effect a required power assisted operation.

17. A power tool according to claim 16 wherein said vane is of substantially cylindrical form and has a multiplicity of openings therein, and said fuel impinges on the convex side of said vane as the fuel enters the combustion chamber.

18. A power tool according to claim 16 wherein said valve means, said inlet means, said outlet means, and said combustion chamber cooperate so that when said valve means allows communication between said combustion chamber and both said inlet and outlet means and said piston is at its first position, said fuel is directed into said combustion chamber in a manner scouring the combustion chamber of residual gases from a preceding cycle of operation of the tool and sweeps said residual gases out through said outlet means prior to the valve means adopting a condition in which said outlet means is closed.

19. A power tool according to claim 16 wherein ignition of fuel within said combustion chamber occurs momentarily prior to said valve means closing in use.

20. A power tool according to claim 1 wherein said ignition means includes multiple electrodes arranged to spark substantially simultaneously at different positions within said combustion chamber.

21. A power tool according to claim 1 wherein said valve means includes a stem mounted in a sleeve in said body and a valve member in the form of a closure plate, the configuration of said closure plate arranged to create turbulence within said combustion chamber as said valve means moves towards its closed condition.

22. A power tool according to claim 21 which includes a lubricant reservoir in communication with said sleeve, and in use lubricant lubricates the relative sliding movement of said stem.

23. A power tool according to claim 22 wherein said reservoir includes a closable opening for replenishment of lubricant, and an inspection panel for visually inspecting the level of lubricant in said reservoir.

24. A power tool according to claim 1 wherein said outlet means has a diameter at least 1.5 times the diameter of the inlet means.

25. A power tool according to claim 1 wherein fuel is supplied to said combustion chamber in a stream which passes through a venture and air is entrained into said fuel stream in said venturi, said inlet means having a diameter at least equal to the diameter of said venturi.

26. A portable power tool comprising:

a body;

a bore within said body;

a piston, slidably mounted within said bore for movement in one direction from a first position through a power stroke into a second position and in an opposite direction through a return stroke;

a combustion chamber formed in said body and communicating with said bore at an end remote from said second position of said piston and being arranged to receive a gaseous fuel for ignition and combustion;

inlet means for admitting said fuel to said combustion chamber;

outlet means for exhausting residual gases from said combustion chamber;

valve means operable to control said admission and said exhaust through said inlet means and outlet means respectively;

supply means for supplying said fuel to said inlet means;

ignition means for igniting said fuel in said combustion chamber;

said valve means being movable between open and closed position; and a lubricant reservoir connected to said valve means and arranged to supply lubricant to said valve means to thereby facilitate movement of said valve means between said open and closed positions.

* * * * *